United States Patent [19]

Trehn et al.

[11] 3,959,632

[45] May 25, 1976

[54] SERVICE PURCHASING SYSTEM

[76] Inventors: Karl Bengt I:son Trehn, Lillgarden, Overby, 150 12 Stjarnhov; Nils Henrik Swahn, Granevagen 8, 182 65 Djursholm, both of Sweden

[22] Filed: Apr. 29, 1974

[21] Appl. No.: 465,329

[30] Foreign Application Priority Data

Apr. 27, 1973 Sweden ..... 7359982

[52] U.S. Cl. ..... 235/92 AC; 235/92 TC; 235/92 EA; 235/92 R; 235/61.8 A; 340/51

[51] Int. Cl.[2] ..... G06M 1/24; G06M 3/12

[58] Field of Search ..... 235/92 CT, 92 AC, 92 PE, 235/92 FL, 92 TC, 92 EA, 61.7 B, 61.8 A; 340/149 B, 379, 51; 235/61.7 B, 61.8 A; 194/DIG. 21, DIG. 22, DIG. 23; 221/2, 7

[56] References Cited

UNITED STATES PATENTS

| | | | |
|---|---|---|---|
| 3,120,602 | 2/1964 | LaGarde | 235/92 AC |
| 3,436,530 | 4/1969 | Faude et al. | 235/92 AC |
| 3,670,924 | 6/1972 | Aspeir | 235/92 PD |
| 3,786,960 | 1/1974 | Young | 235/92 FL |

*Primary Examiner*—Joseph M. Thesz
*Attorney, Agent, or Firm*—Burns, Doane, Swecker & Mathis

[57] ABSTRACT

A system for purchasing service, as parking of a vehicle in a space requiring a fee, comprises storage devices operable of storing a paid service fee and controlled by the purchaser of the service and an information feed device, which is not controlled by the purchaser. The storage device can be connected, when required, to the information feed device to be fed information equal to the magnitude of a purchase. The storage device and the information feed device are provided with interconnected electrical decoding means which interchange coded electrical signals to test electrical characteristics of a storage meter to determine that it is one belonging to the system before information is fed to it.

5 Claims, 5 Drawing Figures

SERVICE PURCHASING SYSTEM

FIELD OF THE INVENTION

The present invention relates to a service purchasing system comprising a storage device which is arranged to store a paid service fee and which is controlled by the purchaser of said service, and a further device over which the purchaser has no control and which, when required, feeds said storage device with information relating to the magnitude of the purchase made.

OBJECTS OF THE PRESENT INVENTION

An object of the invention is to provide a system which enables the advance purchase of a service and which can be used in respect of any form of service. For the sake of simplicity, however, the system will be described hereinafter with reference to its use in the purchase of parking space for a motorvehicle.

In the exemplified use of the stytem, it is proposed that the service fee storing device comprises a small battery driven parking meter, which is capable of being placed on the inside of the windscreen of a vehicle, with one panel of the device fully visible from outside the vehicle, thereby enabling a parking attendent to superintend the operation of said device. Thus, the service fee storage device is able to replace the conventional controlled parking system, with which a parking meter is permanently positioned along the curb of a road or at a controlled parking lot. The service fee storage device of the present invention may also be used in conjunction with the parking of vehicles in private garages, where payment must be made for the right to use the garage but where no particular parking space is hired. If it is now assumed that the service fee storage device is provided with a counter mechanism, said mechanism shall, in accordance with the invention, be arranged to count down in dependence of a time function only during the time in which the vehicle is parked. Further, the counter mechanism shall be capable of being adjusted in a further device which is not controlled by the purchaser of the service and which is arranged to feed to the service storage device information relating to the magnitude of the purchase made.

In accordance herewith, a service purchasing system according to the invention is characterized in that the further device has at least one detecting circuit which is arranged to identify the service fee storage device belonging to said service purchasing system and which, when correctly activated, is arranged to cause the magnitude of the purchase made to be fed to said storage device.

BRIEF DESCRIPTION OF THE DRAWINGS

So that the invention will be more readily understood and further features thereof made apparent, a service purchasing system constructed in accordance with the invention will now be described with reference to the accompanying drawings in which.

DESCRIPTION OF THE PREFERRED EMBODIMENT

The service purchasing system of the present invention comprises a device arranged to store a paid service fee and controlled by the purchaser and a further device, which is not controlled by the purchaser, for feeding, to the storage device when necessary, information relating to the magnitude of the purchase made. Since it is assumed that each person utilizing the system shall have control over a service fee storage device, said device will be described first.

Figure 1:
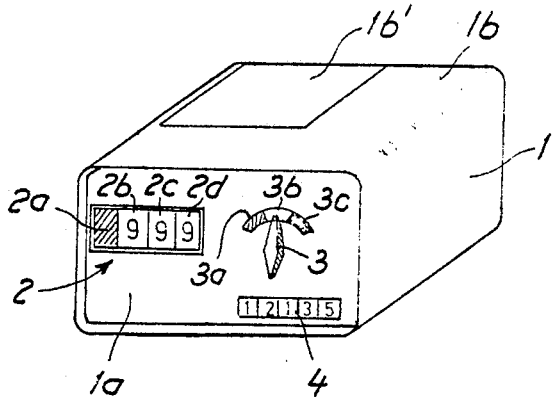
FIG. 1 is a side view in perspective of a device arranged to store a paid service fee.

In FIG. 1 there is shown a device 1 which is arranged to store a paid service fee and which presents at its front surface or panel 1*a*, a counter mechanism 2. In the illustrated embodiment, the counter mechanism comprises four number-bearing counters, wherewith the counter to the left of FIG. 1 is encircled by a circular disc divided into different colour combinations. This latter disc is identified by the reference 2*a*, while the remaining counters are identified by references 2*b*, 2*c* and 2*d*.

On the front panel 1*a* is arranged a switch 3 which can be set to one of three different markings 3*a*, 3*b*, 3*c*, said markings denoting different count-down rates for the counter mechanism 2 in respect of in which zone or in which area the vehicle is parked. The front panel 1a also has arranged thereon a digit combination 4 and, although not shown, is conveniently provided with a serial number visible on the front side of the panel. The serial number can be used to identify the device if the device is stolen. Should the device be stolen, it is a relatively easy matter to report the serial number of the device to the police and to parking attendents. Obviously, the expedient of providing the device with a serial number will assist in detering persons from unlawfully removing said device. As will be seen from FIG. 1, the upper surface 1*b* of the device is provided with a flap 1*b'* which covers a storage space for one or more batteries for operating the device.

Figure 2:
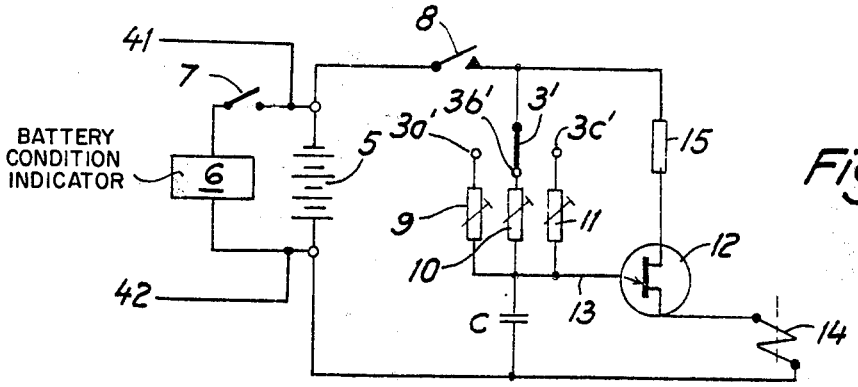
FIG. 2 shows countdown circuits incorporated in the device illustrated in FIG. 1.

FIG. 2 shows part of the circuitry incorporated in the device of FIG. 1. The device is operated by a battery 5, which is connected to a battery indicator 6 over a contact 7. This arrangement enables the condition of the battery 5 to be checked. The device is energized via a contact 8, which with the illustrated embodiment has the form of a built-in reed contact. The device is arranged to be mounted on a stationary magnetic plate so that when said device is positioned on said plate inside the windscreen of a vehicle, with the front panel of the device visible from outside the vehicle said device is automatically set into operation. Thus, upon insertion of the device into its position in the vehicle the magnetic plate will activate the reed contact, which is arranged to energize the timing circuit to count down the counter mechanism 2. The switch 3 is arranged to coact with a contact 3', to move said contact to any one of the shown positions 3*a'*, 3*b'* or 3*c'*. Each of the contact positions 3*a'*, 3*b'* and 3*c'* is connected to its respective resistance 9, 10 and 11. The resistances 9, 10 and 11 have mutually different resistance values and, by means of a capacitor C, provide a change in the time constant. In operation, the battery charges the capacitor C, the voltage of which slowly rises so that when the voltage on line 13, which is connected to a double base diode 12, exceeds a predetermined magnitude, the voltage is discharged over capacitor C1 via a magnetization coil 14, which is arranged to step down the counter mechanism 2 one step, i.e. from the illustrated digits nine to a position corresponding to the number eight. The double based diode 12 is arranged to be operated over a resistance 15. Thus, when the charge on the capacitor C is discharged via the double base diode 12, a new charging sequence takes place and as soon as the voltage over capacitor C has reached a predetermined value a discharging sequence takes place over the magnetization coil 14, which again steps down the counter 2*d*. As previously mentioned, the rate at which the counter wheel 2*d* is stepped down depends upon the magnitude of resistances 9, 10 and 11.

The markings 3*a*, 3*b*, 3*c* on the front panel may be in the form of coloured sections. The colours used shall correspond to the colours relating to different parking zones. By setting the switch 3 to the colour of the relevant parking zone, the time circuit will produce pulses for counting down the counting mechanism 2, and the count-down frequency is clearly determined by the circuits incorporated in the device.

As mentioned above, the number contained or stored in the counting mechanism is progressively decreased. With the embodiment illustrated in FIG. 1, it is assumed that the counter 1*a* with its surrounding disc shows a green colour. When the number contained by the counting mechanism has been decreased to 000, the counter 2*a* is also displaced and a red blinker is arranged to show that the zero mark has been passed. The counting mechanism is arranged to stop automatically when this position is reached. The storage device shown in FIG. 1 must now be processed in a device not capable of being controlled by the person purchasing the service, for feeding to the storage device information concerning the magnitude of the purchase made.

With a new purchase, the counter 2*a* is rotated to show a green colour, while counters 2*b*, 2*c* and 2*d* take the position shown in FIG. 1. If it is assumed that the purchase is made before the counter 2*a* has passed to a red marking and that the counter 2*b*, 2*c* and 2*d* adopt positions corresponding to 020, the magnitude of the purchase made can still be fed to the storage device, by causing the counter 2*a* to show a white colour. Subsequent to the purchase being made, the counter 2a will thus show a white colour while the counter 2*b* adopts position zero, the counter 2*c* adopts position 2 and the counter 2d adopts position zero. As described above, when the storage device is used a count-down takes place and when the setting reaches 000, the counter 2a will pass from a white colour to a green colour.

Figure 4:
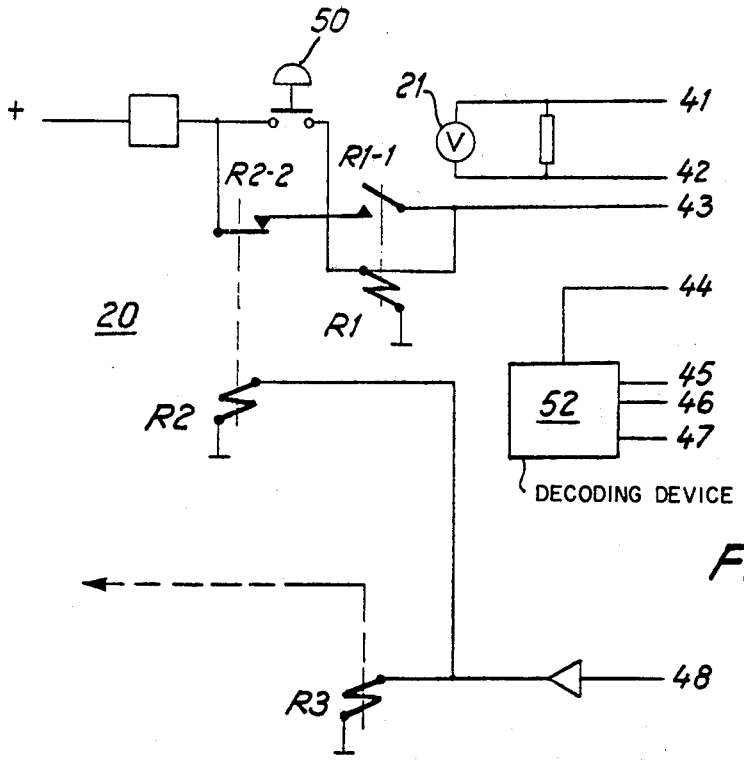
FIG. 4 is a wiring diagram showing certain components incorporated in the storage device.
Figure 5:
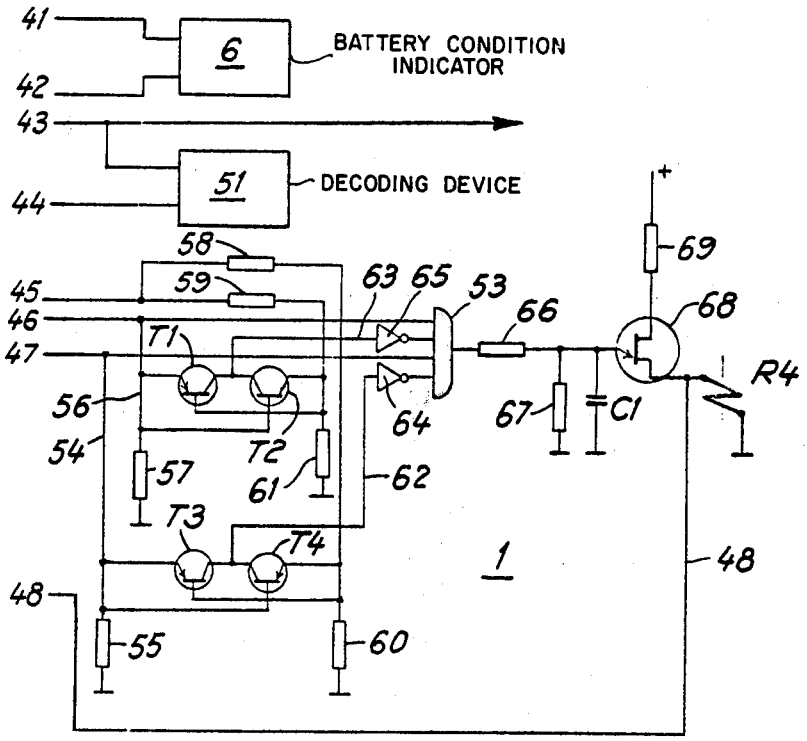
FIG. 5 is a wiring diagram of the device for storing information concerning the magnitude of the purchase made.

FIGS. 4 and 5 show circuitry for feeding information concerning the magnitude of the service purchased to the storage device. The information feed device, which cannot be controlled by the person making the purchase, has the circuitry shown in FIG. 4, while the storage device has the circuitry shown in FIG. 5.

Figure 3:
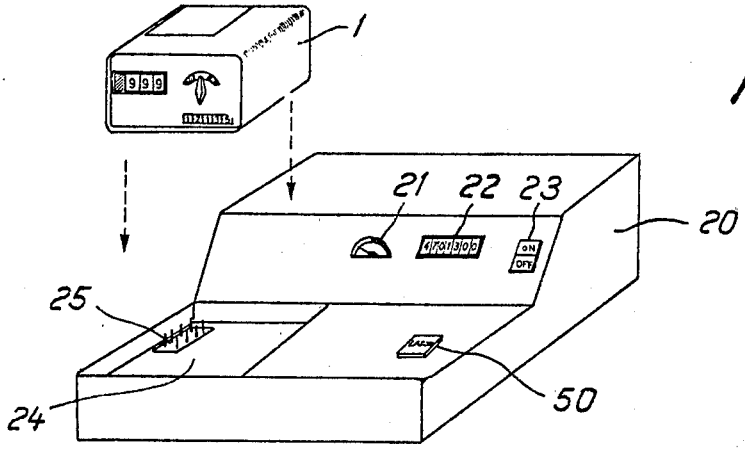
FIG. 3 shows by way of example the manner in which the device for storing a paid service fee can be arranged to co-operate with a device which, when required, will feed to the storage device information concerning the magnitude of the purchase made.

FIG. 3 illustrates how a storage device 1 can be placed in a information feed device 20 which can not be controlled by the purchaser and which has on its front panel an indicator 21 arranged to test the condition of the battery 5, a counting mechanism 22 arranged to store the magnitude of the purchase made, and switches 23 for switching the device 20 on and off. The information feed device 20 has a recess 24, in the bottom of which there are provided contact pins 25, said pins being eight in number and being arranged to co-act with a contact sleeve in the storage device 1. An important feature of the illustrated system is that the recess 24 is provided with edge surfaces which can embrace the storage device 1 subsequent to said device being inserted into co-action with the pins 25.

The described co-action between the pins 25 and the contact sleeve of the storage device 1 is illustrated in FIGS. 4 and 5 with lines 41–48. The lines 41 and 42 are arranged to provide indication on and indicator 21 of the condition of battery 5. Arranged on the information feed device 20 is a button 50 which, when depressed, causes a positive potential to prevail on line 43 and, simultaneously, a relay R1 to be activated. The relay R1 operates in conjunction with a contact R1-1, via which contact the relay R1 obtains a selfholding effect over a contact R2-2 operating in conjunction with a second relay R2.

The signal occurring on line 43 is connected to a decoding device 51 which produces a specific signal on line 44 in response to the voltage on line 43. The signal on line 44 is fed back to the device 20 to a decoder 52, arranged therein, said decoder 52 being arranged to transmit signals on lines 45, 46 and 47 in response to the information on line 44. With the illustrated embodiment, it is assumed that the decoder 52 transmits a constant voltage on line 45, while a constant current is transmitted on lines 46 and 47 with a pre-determined relationship between the current in line 46 and in line 47. The lines 46 and 47 are directly connected to an AND-gate 53, and line 47 is connected via a line 54 to a resistance 55, while line 46 is connected via a line 56 to a resistance 57. The line 45 is connected via resistance 58 and 59 to resistance 60 and 61. With the aid of transistors T1 and T2 and T3 and T4 the signals transmitted from decoder 52 are sensed as to their correctness, and when the signal sensed by said transistors are the correct signals, a signal is obtained over line 62 and 63, said signal being inverted in invertors 64 and 65 for connection to the AND-gate 53. The output signal from the AND-gate 53 is applied to a capacitor C1 over a resistance 66, 67, whereupon the capacitor C1 is slowly charged and at a pre-determined voltage level causes the double base diode 68 to be activated, which diode, via resistance 69, activates the relay R4 which, with the illustrated embodiment, is arranged to activate the sleeve positioned above counter 2a to move said sleeve from a red marking to a green marking or from a green marking to a white marking. The relay R3 is activated via line 48, which is connected to the output of the double base diode 68, whereupon said relay causes the counting mechanism 22 of the device 20 to be stepped forward, while relay R2 is also activated to break the contact R2-2, thereby automatically disconnecting the signal on line 43.

The invention is not restricted to the illustrated embodiment but can be modified within the scope of the following claims. Although with the circuitry shown in FIG. 2, it is possible to adjust the resistances 9, 10 and 11, it will be readily perceived that when the time circuits can be given fixed values, fixed resistance values can also be used.

With the illustrated embodiment, the first code signal from the device 20 to the device 1 has been described as a simple plus potential, although it will readily be perceived that this signal may be made more complicated. In each instance, the code signal transmitted from the device 20 to the device 1 is an electric analogue signal to a mechanical lock, and this is complemented by arranging for the decoder 51 to send via line 44 a further code to decoder 52, which in turn sends the code to be evaluated by the circuits in the device 1 via lines 45, 46 and 47. The decoder 52 comprises an analogue current generator which gives a constant current on lines 46 and 47 irrespective of the occurring load. The load resistances incorporated in the device 1 are always at a certain relationship to each other and to the value of the current generated by the current generator. This ensures against unlawful charging of the device shown in FIG. 1. Thus, the analogue current generator will produce such currents and voltages that the AND-gate 53 will only be activated to generate an output signal over resistance 66 when the three voltages have a certain relationship with one another.

Since the constant currents taken out from the device 20 depend upon the combination of resistances in the device 1, they can never be measured beforehand, to enable them to become known by placing a further load on the device 20. The device is placed in a recess in the device 20, the arrangement being such that the storage device does not engage the contact pins on device 20 before the storage device has been inserted to such a depth in the recess that it is impossible to reach the pins to make any sort of measurement on the contact. If the wrong currents are sent from the information feeding device to the storage device, a logic zero is obtained on the AND-gate 53 and no output signal is obtained. The arrangement can also be such that in the event of a wrong voltage being supplied, the storage device will be blow a fuse arranged at some suitable position, thereby rendering the device unusable. Three to five different variations on the resistance values in the detecting circuit of the storage device 1 have been found sufficient. These variations can be readily arranged in the manufacture of the device. Neither it is necessary to indicate which variation is arranged in the storage device 1, since the current generator 52 will always coincide with its own resistance combination.

Although the counting mechanism in the storage device 1 of the illustrated embodiment has been provided with four counters, it will be readily perceived that more counters or fewer counters may be used. It is also possible to complement the storage device 1 so that the relay R4 advances the counting mechanism 2 through an arbitrary number of markings in dependence of the magnitude of the service purchased. In such a case the counter 2a with its different markings may be omitted.

It is also possible to include different control devices for ensuring the operation of the storage device 1. One such control device has been previously described with reference to FIG. 2, and the battery indicator 6 could comprise an illuminating diode which is connected in series with a zener diode over the battery voltage when the contact 7 takes its activated position. It is also possible to incorporate blinkers which are energized by the voltage transients occurring when the system is switched on and is de-energized by such transients when said system is switched off. It is also possible to connect a further contact capable of being actuated by a timing device or the like via the contact 8.

In general the invention provides a detecting circuit for identifying the storage device 1 belonging to the system. The detecting device comprises an analogue current generator (decoder) and/or a specific arrangement of connecting pins between the storage device 1 and the information feed device 20.

The device illustrated in FIG. 1 have different markings arranged on the front panel thereof. These markings could be supplemented with further markings, e.g. symbols designating the district or garage in which the device 1 is intended for use, thereby to indicate that the device is used within the permitted geographical area.

We claim:

1. Service purchasing apparatus comprising a. a storage device controlled by the purchaser of service and operable to store an indication proportional to a service fee paid by the purchaser of service, said storage device including a first electrical signal decoding means, b. an information feed device not controlled by said purchaser of services and adapted to have said storage device connected thereto to feed said storage device with information relating to a purchase made, said information feed device including means for feeding an electrical signal to said first decoding means and second electrical decoding means for receiving and further decoding a signal from said first decoding means, said storage device further including signal responsive means comprising an electrical circuit having predetermined electrical characteristics for receiving a decoded signal from said second decoding means and providing a predetermined signal to indicate that a predetermined relationship exists between the characteristics of the received decoded signal and said predetermined electrical characteristics of said circuit, and means responsive to the provision of said predetermined signal to cause information indicative of the magnitude of a purchase made to be fed to said storage device.

2. Service purchasing apparatus as recited in claim 1, wherein said second decoding means comprises a circuit with analogue current generator means capable of being activated by a signal produced by said first decoding device in response to the signal fed thereto by said information feed device.

3. Service purchasing apparatus as recited in claim 1, wherein said second decoding means provides a plurality of individual electrical signals of predetermined values and said signal responsive means in said storage device includes a circuit arrangement including an electrical circuit responsive to said plurality of signals to operate a logical AND gate in said storage device to provide said predetermined signal to cause said information to be fed to said storage device.

4. Service purchasing apparatus as recited in claim 3, wherein the plurality of individual signals provided by said second decoding means includes two signals having constant currents of different predetermined value and a signal having a constant voltage of predetermined value.

5. Service purchasing apparatus as recited in claim 4, wherein said apparatus is suitable for use in purchasing vehicle parking services and further includes means responsive to the provision of said predetermined signal to cause information to be fed to said storage device to additionally cause an indication in said information feed device.

* * * * *